US005372196A

United States Patent [19]

Andersson

[11] Patent Number: 5,372,196

[45] Date of Patent: Dec. 13, 1994

[54] HAMMER DRILL DEVICE

[75] Inventor: Kurt Andersson, Tyresö, Sweden

[73] Assignee: Atlas Copco Rocktech AB, Stockholm, Sweden

[21] Appl. No.: 76,454

[22] Filed: Jun. 14, 1993

[30] Foreign Application Priority Data

Jul. 7, 1992 [SE] Sweden ..... 9202105-4

[51] Int. Cl.[5] ..... E21B 4/14

[52] U.S. Cl. ..... 175/296; 173/78; 173/91; 173/112

[58] Field of Search ..... 175/69, 92, 202, 296

[56] References Cited

U.S. PATENT DOCUMENTS

| | | | |
|---|---|---|---|
| 4,194,581 | 3/1980 | Walter | 175/92 |
| 4,509,606 | 4/1985 | Willis | 175/69 |
| 4,819,746 | 4/1989 | Brown et al. | 175/296 |
| 5,014,796 | 5/1991 | Gustafsson | 175/296 |
| 5,085,284 | 2/1992 | Fu | 175/296 |
| 5,115,875 | 5/1992 | Ennis | 175/296 X |
| 5,139,096 | 8/1992 | Lister | 175/92 |
| 5,156,223 | 10/1992 | Hipp | 175/296 |

*Primary Examiner*—Michael Powell Buiz
*Assistant Examiner*—Frank S. Tsay
*Attorney, Agent, or Firm*—Mark P. Stone

[57] ABSTRACT

Hammer device comprising a machine housing (1) with a hammer piston (2) movable to-and-fro. The movement to-and-fro of the hammer piston is controlled by a valve body (6) movable to-and-fro in the machine housing. In order to speed up the turning of the hammer piston at its rear end position the machine housing is provided with a room (10) which by the hammer piston is separated from connection with the valve body (6) at the same time as the rear end surface (5) is supplied with pressure fluid via a connection (11) opened by the hammer piston to the pressure source (8) when the hammer piston approaches its rear end position.

4 Claims, 3 Drawing Sheets

HAMMER DRILL DEVICE

BACKGROUND OF THE INVENTION

The present invention relates to a hammer device of the type incorporated in rock drilling machines.

In prior art hammer devices of the above mentioned kind a valve controlled by the hammer piston is used to alternatingly connect a drive surface of the hammer piston either to a pressure supply conduit or to a return conduit in order to drive the hammer piston in a movement to-and-fro in order to exert a drill tool to impacts. With these known designs it has turned out to be difficult to achieve impact frequencies exceeding 80–100 Hz.

SUMMARY OF THE INVENTION

It has long been a desire to increase the impact frequency substantially in order to make the drilling work more efficient.

The present invention, which is defined in the subsequent claims, aims at achieving a hammer device which can be driven with substantially higher impact frequencies, e.g. of the order of 150 Hz.

BRIEF DESCRIPTION OF THE DRAWING

An embodiment of the invention is described below with reference to the accompanying drawings in which.

DESCRIPTION OF THE PREFERRED EMBODIMENT OF THE INVENTION

Figure 1:
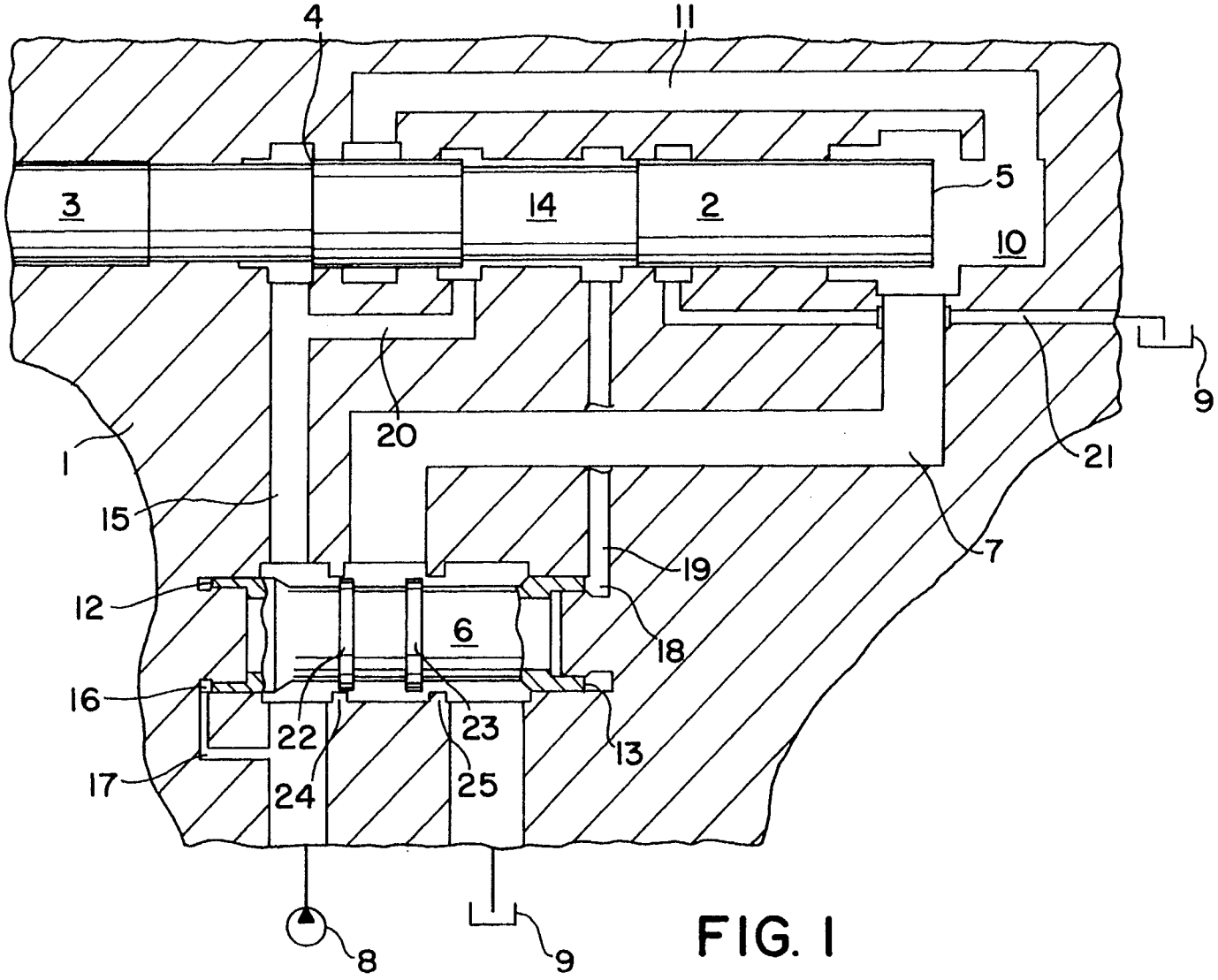
FIG. 1 shows a schematic section through a hammer device with the hammer piston in impact position.
Figure 2:
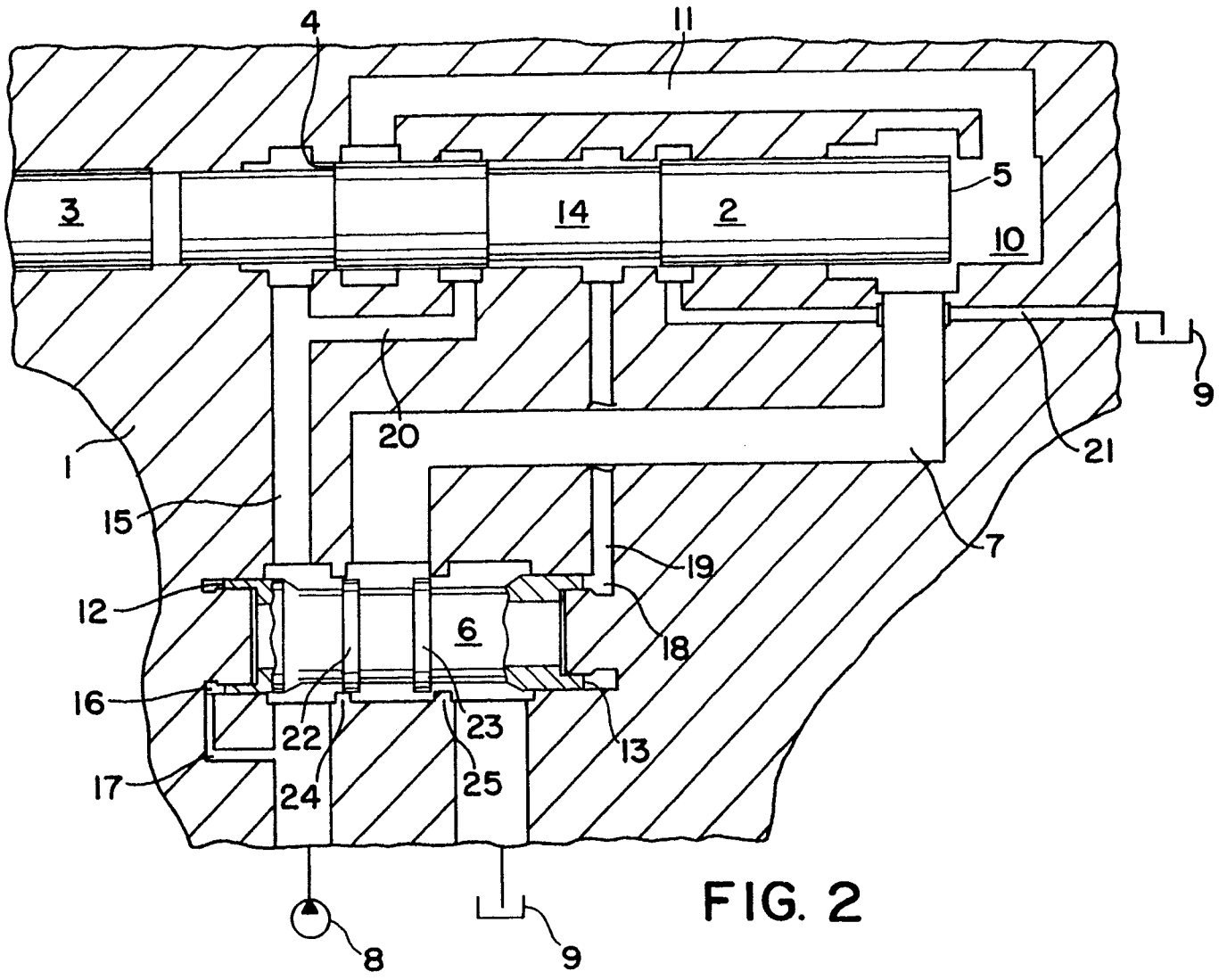
FIG. 2 shows a section with the hammer piston in another position.
Figure 3:
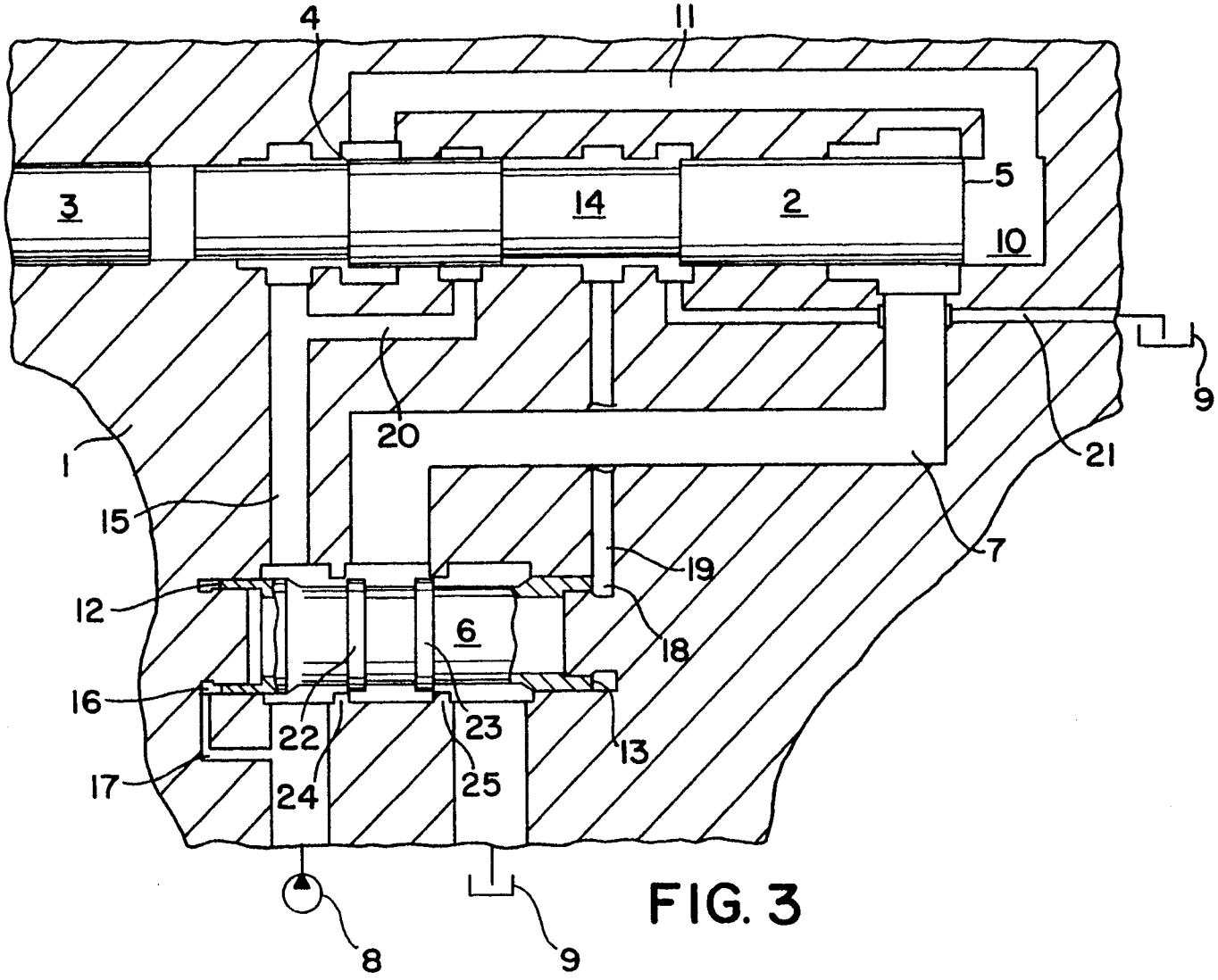
FIG. 3 shows a section with the hammer piston near its rearward end position.

The hammer device shown in the drawings comprises a machine housing 1 in which a hammer piston 2 is movable to-and-fro in order to exert a tool 3 to impacts. The tool is provided with a drill bit (not illustrated) in the usual way. The hammer piston is provided with a first drive surface 4 which in the shown example is continuously pressurized by a pressure source 8 via a channel 15. The hammer piston is furthermore provided with a second drive surface 5 which in the shown example is the rear end surface of the hammer piston. Drive surface 5 is alternatingly connected to pressure source 8 and to the low pressure of tank 9 via a channel 7 and a valve body 6 movable to-and-fro in the machine housing. One can as an alternative connect both drive surfaces alternatingly to the pressure source or the low pressure. In the shown example pressurization of the first drive surface 4 strives at moving the hammer piston to the right in the figure. Since the area of the second drive surface 5 is substantially larger than the area of the first drive surface 4, pressurization of drive surface 5 gives as a result that the hammer piston is driven to the left in the figure against the action of the pressure on drive surface 4. Valve body 6 is made as a tubular slide provided with a first end surface 12 which is exerted to the pressure in first chamber 16. Chamber 16 is via channel 17 connected to pressure source 8. Valve body 6 is furthermore provided with a second end surface 13 which is exerted to the pressure in a second chamber 18. Chamber 18 is via channel 19 connected with the cylinder bore of hammer piston 2. Since the first end surface 12 is continuously pressurized and the second end surface 13 is larger than the first, the movement to-and-fro of the valve body 6 is controlled by the pressure changes, in channel 19. In order to achieve these pressure changes hammer piston 2 is provided with a section 14 with reduced diameter. Through this, channel 19 is connected either to pressure source 8 via channels 20 and 15 as shown in FIG. 1, or via channel 21 to tank 9 as shown in FIGS. 2 and 3. Valve body 6 is provided with two flanges 22 and 23 which cooperate with annular sections 24 and 25 respectively in the machine housing. The inner space of valve body 6 is connected to low pressure, not shown. Machine housing 1 comprises a room 10 into which hammer piston 2 can enter so that it separates room 10 from channel 7. At about the same time as hammer piston 2 enters into room 10, hammer piston 2 opens a connection 11 between channel 15 and room 10. Through this arrangement the backwards movement of the hammer piston is braked by the pressure in room 10 before valve body 6 has changed position so that pressure fluid is supplied via channel 7 for driving hammer piston 2 to the left in the figure.

The hammer device shown in the drawings works in the following way. In the position shown in FIG. 1, hammer piston 2 has just impacted tool 3. Shortly before valve body 6 has been moved to the position shown in FIG. 1 through pressure fluid supply from pressure source 8 via channels 15 and 20, the space about section 14 with reduced diameter on the hammer piston, and channel 19 to chamber 18. In this position room 10 is drained via channel 7 and passed the valve body 6 to tank 9. This means that hammer piston 2 is driven to the right in the figure by the pressure on first drive surface 4. When the hammer piston has come to the position shown in FIG. 2, the hammer piston has closed the connection between channel 20 and the space about section 14 with reduced diameter on the hammer piston. Furthermore the hammer piston has opened a connection between channel 19 and channel 21 through which chamber 18 is connected with tank 9. Valve body 6 then starts moving to the right in the figure. When hammer piston 2 has come to the position shown in FIG. 3, the hammer piston has separated room 10 from channel 7 and opened connection 11 between channel 15 and room 10. Through this, pressure fluid is supplied to room 10 via connection 11 in order to brake the backwards movement of hammer piston 2. In the position shown in FIG. 3, valve body 6 has closed the connection between channel 7 and tank 9. Furthermore a connection has been opened between pressure source 8 and channel 7. The hammer device is designed such that connection 11 for supply of pressure fluid to room 10 is opened earlier than the connection between the pressure source and channel 7. Through this, it is achieved that the change of direction of the movement of the hammer piston is initiated substantially earlier than what is possible through change of position of valve body 6. The result is that the hammer device can be driven with substantially higher impact frequency than what is possible if the movement to-and-fro is controlled by valve body 6 alone. From the position shown in FIG. 3, hammer piston 2 is driven to the left in the figure towards the position shown in FIG. 1. On the way there, the connection between channels 15 and 19 is opened so that the above described process is repeated.

I claim:

1. A hammer drill device comprising a machine housing (1), a hammer piston (2) movable to-and-fro in the machine housing for impacting a tool (3), said hammer piston comprising a first drive surface (4) and a second drive surface (5) intended to be pressurized for driving the hammer piston to-and-fro, and a valve body (6) movable to-and-fro in the machine housing, said valve body being arranged to alternately connect at least the second (5) of said drive surfaces to a source (8) of pressurized fluid to increase the pressure applied to at least said second drive surface and means (9) for decreasing the fluid pressure applied to said at least said second drive surface via a channel (7) arranged in the machine housing, said machine housing (1) defining a space (10), said hammer piston being movable into said space (10) in a first position relative to said space (10) for blocking flow of fluid from said channel (7) and into said space (10) and simultaneously permitting flow of fluid through a passage (11) in fluid communication with said source (8) for braking said hammer piston before said valve body (6) permits flow of said pressurized fluid applied to said at least second drive surface from said source (8).

2. The hammer drill device according to claim 1, wherein said first drive surface (4) continuously is connected with said source (8), and that said second drive surface (5) is a rear end surface of the hammer piston (2).

3. The hammer drill device according to claim 1, wherein said valve body (6) is formed in a tubular configuration having a first end surface (12) which is continuously connected to said source (8) and a second end surface (13) which, through a section (14) with reduced diameter on the hammer piston (2), alternately is connected to the source (8) and to said means (9) for decreasing said pressure.

4. The hammer drill device according to claim 2, wherein said valve body (6) is formed in a tubular configuration having a first end surface (12) which is continuously connected to said source (8) and a second end surface (13) which, through a section (14) with reduced diameter on the hammer piston (2), alternately is connected to the source (8) and to said means (9) for decreasing said pressure.

* * * * *